US009234317B2

(12) United States Patent
Chi

(10) Patent No.: US 9,234,317 B2
(45) **Date of Patent: *Jan. 12, 2016**

(54) ROBUST SYSTEM AND METHOD FOR FORECASTING SOIL COMPACTION PERFORMANCE

(71) Applicant: Caterpillar Inc., Peoria, IL (US)

(72) Inventor: Liqun Chi, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 239 days.

This patent is subject to a terminal disclaimer.

(21) Appl. No.: 14/037,257

(22) Filed: Sep. 25, 2013

(65) Prior Publication Data

US 2015/0088785 A1 Mar. 26, 2015

(51) Int. Cl.
*G06F 17/00* (2006.01)
*G06F 17/20* (2006.01)
*E01C 19/28* (2006.01)

(52) U.S. Cl.
CPC ..... *E01C 19/288* (2013.01)

(58) Field of Classification Search
USPC ..... 706/11
See application file for complete search history.

(56) References Cited

U.S. PATENT DOCUMENTS

| | | | | |
|---|---|---|---|---|
| 6,122,601 | A | 9/2000 | Swanson et al. | |
| 6,188,942 | B1 | 2/2001 | Corcoran et al. | |
| 6,460,006 | B1 | 10/2002 | Corcoran | |
| 6,859,732 | B2 | 2/2005 | Tritico et al. | |
| 7,191,062 | B2 * | 3/2007 | Chi | E02D 3/00 702/137 |
| 7,623,951 | B2 | 11/2009 | Congdon et al. | |
| 7,731,450 | B2 | 6/2010 | Congdon et al. | |
| 7,908,062 | B2 | 3/2011 | Corcoran | |
| 8,116,950 | B2 | 2/2012 | Glee | |
| 8,144,245 | B2 | 3/2012 | Vik | |
| 8,474,070 | B2 * | 7/2013 | Chi | C08G 79/025 4/663 |
| 8,530,561 | B2 * | 9/2013 | Chi | B29C 45/0013 524/427 |
| 9,085,885 | B2 * | 7/2015 | Chi | E03D 11/02 |
| 2005/0158129 | A1 * | 7/2005 | Chi et al. | 405/271 |
| 2007/0239336 | A1 | 10/2007 | Congdon et al. | |

FOREIGN PATENT DOCUMENTS

EP 0761886 A1 3/1997

OTHER PUBLICATIONS

Development of a tractor operated soil compaction measurement device Kumar, M.; Dadhich, H.; Dadhich, S.M. Technologies for Sustainable Development (ICTSD), 2015 International Conference on Year: 2015 pp. 1-4, DOI: 10.1109/ICTSD.2015.7095877 Referenced in: IEEE Conference Publications.*

(Continued)

*Primary Examiner* — Michael B Holmes
(74) *Attorney, Agent, or Firm* — Baker & Hostetler LLP

(57) ABSTRACT

The present disclosure considers a system and method that can predict soil compaction and machine-specific productivity rate across multiple soil conditions without requiring site-specific samples and multi-variable lab testing. The method and system disclosed here can utilize predictive algorithms combined with a soils database to predict soil response to compaction energy across a range of soil moistures for the range of compaction machines available to predict compaction performance.

20 Claims, 3 Drawing Sheets

(56) References Cited

OTHER PUBLICATIONS

Land suitability mapping for implementation of precision farming Abdullah, N.B.; Azhari, A.W.; Hussin, M.S.; Jaafar, M.N. National Postgraduate Conference (NPC), 2011 Year: 2011 pp. 1-6, DOI: 10.1109/NatPC.2011.6136375 Referenced in: IEEE Conference Publications.*

Development of pervasive compaction monitoring interface for soil compactor—A GPS/GSM based approach Prakash, R.; Suresh, K.; Venkatalakshmi, B.; Vijayakumar, S. Recent Trends in Information Technology (ICRTIT), 2013 International Conference on Year: 2013 pp. 569-574, DOI: 10.1109/ICRTIT.2013.6844265 IEEE.*

Delineating the near-surface geometry of the fracture system affecting the valley of Queretaro, Mexico Carreon-Freyre, D.; Cerca, M. Ground Penetrating Radar, 2004. GPR 2004. Proceedings of the Tenth International Conference on Year: 2004 pp. 535-538 Referenced in IEEE Conference Publications.*

* cited by examiner

ROBUST SYSTEM AND METHOD FOR FORECASTING SOIL COMPACTION PERFORMANCE

TECHNICAL FIELD

This patent disclosure relates generally to soil compaction machines, systems, and methods, and, more particularly, to soil compaction forecasting.

BACKGROUND

Calculating the time and resources necessary to reach a desired compaction density may be beneficial for earthworks compaction projects for numerous reasons, including but not limited to for utilization during the bidding process for earthworks compaction projects in addition to further applications in relation to the planning, management, and completion of earthworks compaction projects. In addition to further characteristics, fast and reliable systems and methods for determining the effort necessary to compact a soil region to the requested density may be valuable.

Many currently available methods and systems for forecasting compaction performance rely on performing soil compaction response measurements on soils from the specific site to be compacted. These soil compaction response measurements may be conducted in a laboratory, wherein specific sample may be tested at multiple compaction energies and moisture content levels to create a multivariable output of compaction result due to energy input at varying moisture. These laboratory results may then be compared to field response for a compaction machine operating on the same site specific soil to forecast the machine performance capability across the range of soil moisture. Such methods and systems for forecasting compaction performance are site specific, which may thus require extra time for taking sample and sending them to the laboratory in addition to multi-variable tab testing for each sample. The required extra time and resources which may characterize many currently available compaction forecasting methods and systems may present drawbacks and limitations for the planning, management, and completion of earthworks compaction projects, and particularly during the bidding and soil analysis process.

EP 0761886A1 to (the '886 patent) to Froumentin discloses a method and machine where a compacting machine is linked to a computer that provides the geographical coordinates that guides the compacting machine's path, the number of passes to made over each point by the compacting machine, and the speed at which the compacting machine will travel. The '886 relies upon site specific data and the method and the machine disclosed in the '886 are not predictive. Therefore, while the method and machine disclosed in the '886 patent may make the compacting more efficient it cannot predict the effort necessary to reach a desired soil density.

The present disclosure is directed to mitigating or eliminating one or more of the drawbacks discussed above.

SUMMARY

The present disclosure considers a system and method that may predict soil compaction and machine-specific productivity rate across multiple soil conditions without requiring site-specific samples and multi-variable lab testing. The method and system disclosed here may utilize predictive algorithms combined with a soils database to predict soil response to compaction energy across a range of soil moistures for the range of compaction machines available to predict compaction performance. The method and system of the present disclosure may provide a machine-specific response surface in order to predict performance both in degree of compaction as well as productivity rate with variation in field moisture, depth of the soil, and the number of repeated passes of the machine over the soil. The method and system of the present disclosure may not require testing at all energy levels and moisture contents, because it may predict a complete response surface from a limited number of test points of energy and moisture content.

In one aspect of the present invention, a method of managing soil compaction is disclosed. The method includes the steps of inputting a soil characteristic, a machine characteristic, and a desired soil compaction to determine a site-specific machine performance characteristic.

In another aspect of the present invention, a system configured to manage soil compaction is disclosed. The system includes a controller configured to determine a site-specific machine performance characteristic based on user input of soil characteristics, machine characteristics, and desired soil compaction. The system also includes at least a user interface to receive input of soil characteristics, machine characteristics, and desired soil compaction and a display to show one or more of the machine performance characteristics.

DETAILED DESCRIPTION

Figure 1:
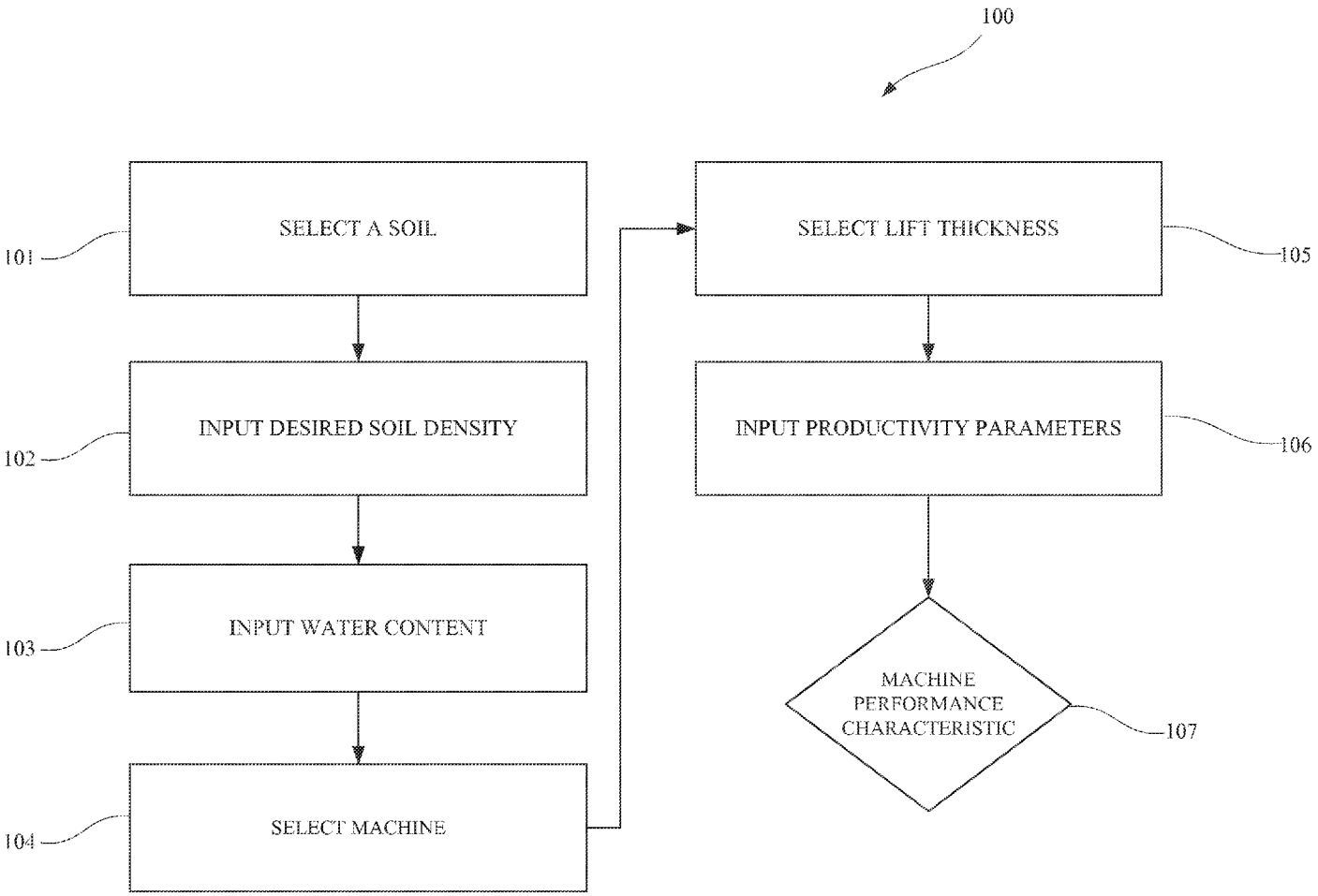
FIG. 1 is a flowchart of an exemplary method that may be used to calculate a machine performance characteristic.

Now referring to the drawings, wherein like reference numbers refer to like elements, FIG. 1 illustrates an exemplary method 100 of forecasting soil compaction. The method 100 can include selection of a soil 101. The select a soil step 101 can include ascertaining composition characteristics of the soil or predictive compaction characteristics of the soil. The composition characteristics of the soil can include components such as gravel, silt, sand, asphalt, or dirt as well as other soil components. The predictive compaction characteristic of the soil can be based on a Proctor model which can determine a predictive compaction density of the particular soil as a function of water content. Other procedures to determine the predictive compaction characteristics of the soil can include determining compaction density as a function of energy level and water content. For example, instead of analyzing a predictive compaction density of the soil at a single energy level, multiple energy levels and multiple water content levels are used to establish more detailed predictive compaction density associated with the soil. The selection of a soil 101 can also include entering the geographic information associated with the soil to be compacted. For example, the select a soil step 101 can include GPS coordinates specifying the location of the soil to be compacted. The select a soil step 101 can be a default input or can be an input by a user.

The exemplary method 100 can include an input desired or target soil density step 102. The desired or target soil density can also be based on the select a soil step 101 and the input water content step 103. A Proctor model can be used to provide the information for the input target soil density step 102. The input desired soil density step 102 can be a default input, can be an input from a computer based on calculations using other data, or can be an input by a user.

The exemplary method 100 may include an input water content step 103. The input water content step 103 may be a default input, may be an input from a computer based on calculations using other data, or may be an input by a user.

The exemplary method 100 may include a select machine step 104. The select machine step 104 may include selecting multiple machines in order to determine the machine performance characteristic 107 for multiple machines or it may include selecting one machine and determining the machine performance characteristic 107 for just one machine. The machine characteristics may include yoke mass, drum mass, drum diameter, drum width, eccentric features, drum frequency, or isomount stiffness. The machine characteristics may conic from a database within a module coupled to the machine or from a remote database that is in communication with a component of the machine.

The exemplary method 100 may also include a select lift thickness step 105. The select lift thickness step 105 may be a default input, may be an input from a computer based on calculations using other data, or may be an input by a user. The default settings for the lift thickness may be associated with the size of the machine. Likewise, the input from the user concerning lift thickness may be approximate ranges based on the size of the machine.

The exemplary method 100 may also include an input productivity parameters step 106. The input productivity parameters step 106 may be a default input, may be an input from a computer based on calculations using other data, or may be an input by a user. The productivity parameter may include the speed of the machine or the efficiency of the machine. The speed of the machine may be directly inputted by the user or determined from default settings. The efficiency of the machine may be directly inputted by the user or determined from default settings.

The exemplary method 100 may also output a machine performance characteristic 107. In one embodiment, the machine performance characteristic may be the number of passes necessary for a specific machine to reach the desired soil density. The present disclosure contemplates a method where the number of passes may be determined by inputting at least one of the following: desired soil density, characteristics of the soil to be compacted, machine characteristics, water content of the soil, lift thickness, and productivity parameters.

The desired soil density may be directly inputted by the user or determined from default settings. The soil characteristics may include some of the following: initial soil density, predetermined soil identification based on prior laboratory or field tests, classification based on the soil components. The soil components may include gravel, silt, sand, asphalt, or dirt as well as other soil components. The water content may be directly inputted by the user or determined from default settings. The optimal water content may be determined using a Proctor model. The machine characteristics may include yoke mass, drum mass, drum diameter, drum width, eccentric features, drum frequency, or isomount stiffness. The machine characteristics may come from a database within a module coupled to the machine or from a remote database that is in communication with a component of the machine. The machine characteristics may also come from direct input from the user or the machine. The lift thickness may come from default settings associated with the machine or from direct input from the user. The default settings for the lift thickness may be associated with the size of the machine. Likewise, the input from the user concerning lift thickness may be approximate ranges based on the size of the machine. The productivity parameter may include the speed of the machine or the efficiency of the machine. The speed of the machine may be directly inputted by the user or determined from default settings. The efficiency of the machine may be directly inputted by the user or determined from default settings.

After inputting at least one of the characteristics of the soil to be compacted, the machine characteristics, the water content of the soil, the lift thickness, or the productivity parameters, a response surface value may be calculated. With the response surface value the number of passes necessary to reach the desired soil density may be calculate using the following calculation where ρ is the desired soil density, "$\rho_{init}$" is the initial soil density, "Δρ" is the difference between the maximum soil density and the initial soil density, "Pass" is the number of passes made by the machine, and "a" is response surface value:

$$\rho=\rho_{init}+(\mathrm{Pass}/(a+(\mathrm{Pass}/\Delta\rho)))$$

The "Δρ" and "a" values above may be unique for each machine under a particular lift thickness. The "Δρ" and "a" values may be determined by field test data and the response surfaces.

After calculating the number of passes, the productivity of a specific machine may be calculated based on the machine characteristics and the productivity parameters of the machine. After calculating the number of passes an optimal compaction machine may be suggested based on the calculated number of passes, default machine characteristics, and default productivity parameters of the machines.

In one embodiment of the disclosed method, the machine performance characteristic 107 may be the machine identification number. In this embodiment the machine identification number may be determined by inputting at least one of the following: desired soil density, characteristics of the soil to be compacted, or water content of the soil. The desired soil density may be directly inputted by the user or determined from default settings. The soil characteristics may include some of the following: initial soil density, predetermined soil identification based on prior laboratory or field tests, classification based on the soil components. The water content may be directly inputted by the user or determined from default settings. The optimal water content may be determined using a Proctor model. The number of passes required for multiple machines based on the machine characteristics, lift thickness, or productivity parameters may be calculated as disclosed above. Based on the number of passes required for each machine the user may select a machine with the optimal productivity. If no machine identification number is predicted to achieve the desired soil density, the user may be notified.

In one embodiment of the disclosed method, additional analysis may be performed to assess whether the addition of soil additives, changes in lift thickness, or changes in moisture content would result in one or more of the machines being able to achieve the desired soil density. If so, user may be notified of the additional compaction process characteristics needed to achieve the desired soil density for a specific machine. If multiple machines are able to achieve the desired soil density, then additional analysis may be performed to recommend a particular machine based on predicted compaction results, and productivity characteristics. For example, a machine that weighs more may have more operational costs (e.g., fuel costs, maintenance cost etc.) associated with it than a lighter machine. If both can achieve the desired compaction, then the machine having lower operating cost may be recommended. Other productivity characteristics that may be accounted for include the speed at which a machine can go, the width of the roller, the number of passes needed by the machine etc.

In another embodiment of the disclosed method, the machine performance characteristic may be a designated route of the machine. The designated route may be based on GPS coordinates and may be determined by the machine characteristics, productivity parameters, and the number of passes needed to reach the desired soil density. The machine performance characteristic may also be a designated routes of multiple machines based on each machine's characteristics and productivity parameters.

In one embodiment, the machine performance characteristics may be updated based upon a rainfall that occurred after the soil sample(s) was taken. This update may enable a more reliable prediction regarding compaction capability. In addition, the compaction prediction, including machine selection, may be reviewed in light of a current moisture level, or predicted rainfall etc. For example, in bid analysis, predicted rainfall may be used to plan the compaction process, e.g., the type(s) of machines needed, the impact of rain on achieving the desired compaction density etc. If the soil sample was taken in a dry season, and compaction is to occur in a more humid or rainy season, then this may be taken into account with productivity and compaction predictions, based on the sensitivity of the ability to compact the soil to moisture, and the ability of a machine to compact the soil based on the moisture content.

Figure 2:
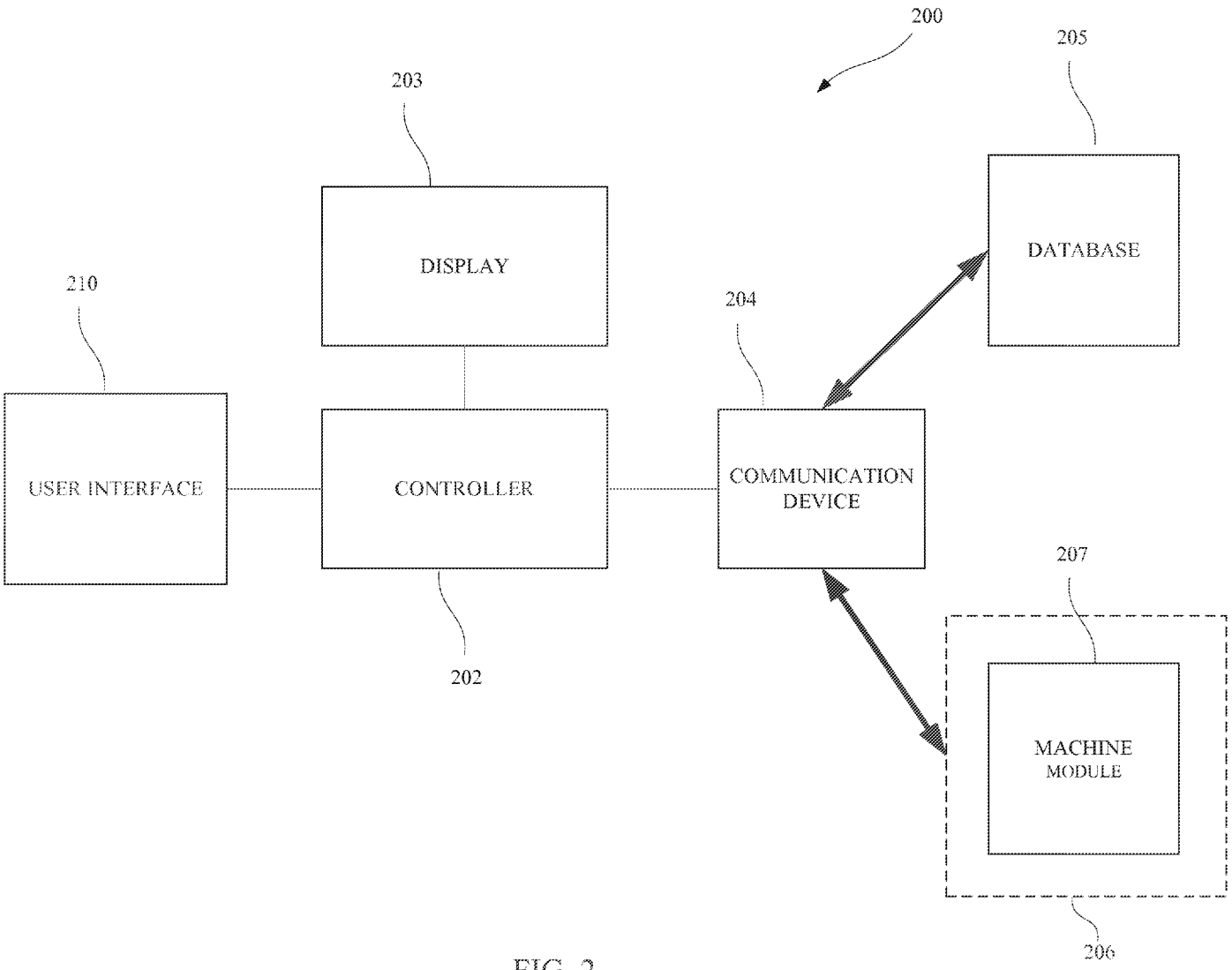
FIG. 2 is a schematic illustration of an exemplary system that may calculate one or more machine performance characteristics.

FIG. 2 illustrates an exemplary system 200 configured to forecast soil compaction. The system 200 may include a user interface 210 configured to receive inputs associated with the soil compaction from a user, and a display 203 configured to display information associated with the soil compaction. The system 200 may include also include a controller 202 configured to perform calculations relevant to the soil compaction forecast. In addition, the system 200 may include a database 205 configured to store information associated with the soil compaction. For example, the database 205 may include data associated with previously analyzed soil. The data may include lab analysis of the soil, compaction predictions associated with the soil, and actual compaction characteristics associated with the soil. As will be described below, the system 200 may include a communication device 204 configured to communicate with a database 205 and a machine module 207 within a machine 206 used for soil compaction. The communication device 204 includes a wireless communication network and/or a landline. For example, the system 200 may communicate compaction information to a machine module 207 within a machine 206 involved in the compaction process. In addition, the system 200 may include a web-based interface such that users at the remote data facility or the machine module 207 within a machine 206 may access the web site and obtain desired compaction information. The user interface 210, controller 202, display 203, and communication device 204 may form a machine module 207 incorporated into the machine 206 or may be remote from the machine 206. Furthermore, the database 205 may be incorporated into the machine 206 or remote from the machine 206. The database may also be also be included with the user interface 210, controller 202, display 203, and communication device 204 in the machine module.

In one embodiment, the controller 202 may determine the number of passes necessary for a specific machine to reach the desired soil density. The present disclosure contemplates a system where the number of passes may be determined by inputting at least one of the following: desired soil density, characteristics of the soil to be compacted, machine characteristics, water content of the soil, lift thickness, and productivity parameters.

The desired soil density may be directly inputted by the user through the user interface 210 or determined from default settings provided by the database 205 via the communication device 204. The soil characteristics may include some of the following: initial soil density, predetermined soil identification based on prior laboratory or field tests, classification based on the soil components. The soil components may include gravel, silt, sand, asphalt, or dirt as well as other soil components. The water content may be directly inputted by the user through the user interface 210 or determined from default settings provided by the database 205 via the communication device 204. The optimal water content may be determined using a Proctor model. The machine characteristics may include yoke mass, drum mass, drum diameter, drum width, eccentric features, drum frequency, or isomount stiffness. The machine characteristics from a user through the user interface 210 or from the database 205 via the communication device 204. The lift thickness may come from the user through the user interface 210 or the database 205 via the communication device 204. The productivity parameter may include the speed of the machine or the efficiency of the machine. The speed of the machine may be directly inputted by the user through the user interface 210 or determined from default settings provided by the database 205 via the communication device 204. The efficiency of the machine may also be directly inputted by the user through the user interface 210 or determined from default settings provided by the database 205 via the communication device 204.

After inputting at least one of the characteristics of the soil to be compacted either by the user through the user interface 210 or from database 205 via the communication device 204, the controller 202 may calculate a response surface value. With the response surface value the controller 202 may calculate the number of passes necessary to reach the desired soil density using the following calculation where "ρ" is the desired soil density, "$\rho_{init}$" is the initial soil density, "Δρ" is the difference between the maximum soil density and the initial soil density, "Pass" is the number of passes made by the machine, and "a" is response surface value:

$$\rho=\rho_{init}+(\text{Pass}/(a+(\text{Pass}/\Delta\rho)))$$

The "Δρ" and "a" values above may be unique for each machine under a particular lift thickness. The "Δρ" and "a" values may be determined by field test data and the response surfaces.

After calculating the number of passes, the controller 202 may calculate the productivity of a specific machine based on the machine characteristics and the productivity parameters of the machine. After calculating the number of passes an optimal compaction machine may be suggested based on the calculated number of passes, default machine characteristics, and default productivity parameters of the machines.

In one embodiment of the disclosed system 200, the controller 202 may determine the optimal machine 206 for the compaction project. In this embodiment the controller 202 may use at least one of the following: desired soil density, characteristics of the soil to be compacted, or water content of the soil to select the optimal machine 206 for the compaction project.

In another embodiment of the disclosed system 200, the controller 202 may perform additional analysis may be performed to assess whether the addition of soil additives, changes in lift thickness, or changes in moisture content would result in one or more of the machines being able to achieve the desired soil density. If so, user may be notified, through the display 203, of the additional compaction process characteristics needed to achieve the desired soil density for a specific machine. If multiple machines 206 are able to achieve the desired soil density, then additional analysis may be performed to recommend a particular machine 206 based on machine characteristics and productivity parameters.

In another embodiment of the disclosed system 200, the controller 202 may designated a route for the machine 206. The designated route may be based on GPS coordinates and may be determined by the machine characteristics, productivity parameters, and the number of passes needed to reach the desired soil density. The controller 202 may also be a designated routes of multiple machines based on each machine's characteristics and productivity parameters. Therefore the system 200 is capable of performing route planning and route management.

Figure 3:
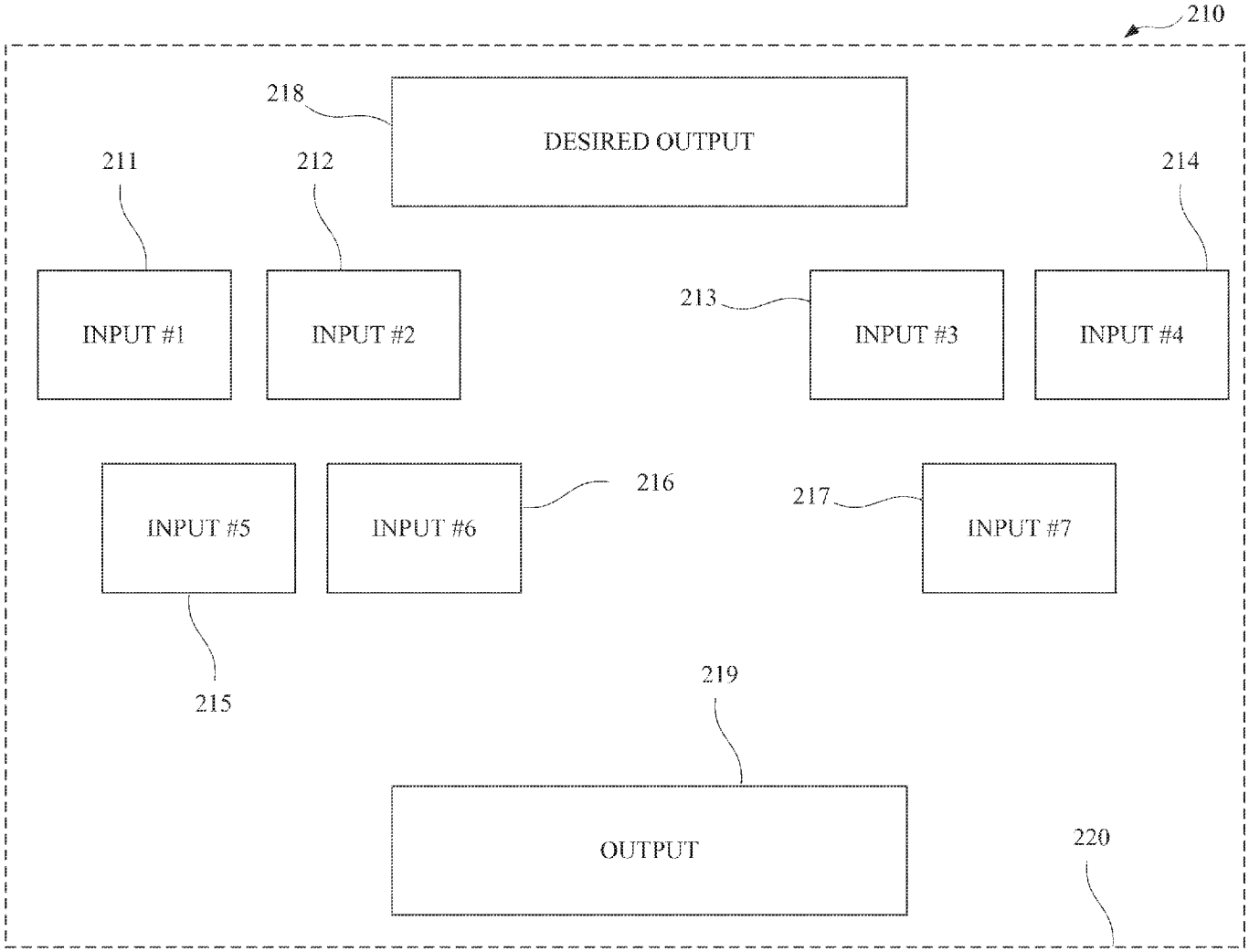
FIG. 3 is a schematic illustration of an exemplary user interface.

FIG. 3 illustrates an exemplary user interface 210, which can be used in the exemplary system 200. The exemplary user interface 210 can include multiple fields for inputs 211-217, a field for desired output 218, and an output 219. The fields for inputs 211-217, can set to receive information including desired soil density, machine selection, characteristics of the soil to be compacted, machine characteristics, water content of the soil, lift thickness, or productivity parameters. The user can provide information to one or more of the fields for inputs 211-217. The user can provide a desired output 218, including number of passes, selection of optimal machine(s), lift thickness, estimated machine productivity, or optimum water content. The user interface can show the output 219, which can be the number of passes, selection of optimal machine(s), lift thickness, estimated machine productivity, or optimum water content.

The exemplary user interface 210 can be incorporated into a compaction machine or it can be in a wireless device in communication with the controller 202 through the communication device 204. The fields for inputs 211-217 can include drop-down menus to select different preset inputs or the fields for inputs 211-217 can allow the user to search for preset inputs or enter a new input. The user interface 210 can be embodied, in one embodiment, as a graphical, digital, or other type of user interface such as a touchscreen. The user interface 210 can also be embodied in a computing device 220. The computing device 220 containing the user interface 210 can be permanently separate from or detachably connected to the machine 206. The computing device 220 can be a personal or mobile computing device such as a smartphone, tablet, or other type of suitable device.

The present invention also contemplates a machine 206 used for soil compacting which includes an user interface 210 configured to receive compaction data, a controller 202 configured to determine a machine performance characteristic based on compaction data, and a communication device configured to communicate the compaction data between a database or with a second machine. Again the compaction data can include desired soil density, machine selection, characteristics of the soil to be compacted, machine characteristics, water content of the soil, lift thickness, or productivity parameters. The database 205 that provides the compaction data can be incorporated into the machine or remote from the machine 206.

INDUSTRIAL APPLICABILITY

The present disclosure includes a system 200 and method 100 of forecasting soil compaction. The method 100 includes a select soil step 101, an input desired soil density step 102, an input water content step 103, a select machine step 104, a select lift thickness step 105, an input productivity parameters step 106, and determining a machine performance characteristic 107. In the present disclosure the soil characteristics do not have to some from site-specific samples. Instead the soil characteristic may come from a database 205 of soil characteristics. The soil characteristics may include composition properties of the soil and predictive compaction characteristics of the soil.

In the present disclosure a user may enter desired compaction characteristics into the system 200, such as desired compaction density etc. The user may request that a machine 206 be recommended that is capable of achieving the desired compaction characteristics. The system 200 may responsively recommend one or more machines 206 capable of achieving the desired compaction characteristics. The system 200 may recommend multiple machines to accomplish the compaction, assign compaction routes to the machines 206, and predict productivity characteristics associated with the machines. These route assignments may be delivered to compaction machines 206, and used by the machines 206 (or operators of the machine) to begin compaction.

The present disclosure may apply to all compaction machines 206 and across the range of earthworks construction soils. Additional soils and machines may be added to a database as additional compaction data becomes available. The present disclosure contemplates that as more soil response to compaction energy data is compiled and as more machine data on compaction productivity is compiled the present disclosure may also apply to other machines not specifically design as compaction machines.

The present disclosure may provide improvements to the compaction forecasting process. One improvement may provide algorithms that predict soil response to compaction energy across a range of soil moisture. These algorithms may make it unnecessary to perform testing at all energy levels and moisture contents. The algorithms may predict a complete response surface from a limited number of test points of energy and moisture content. Other algorithms may predict compaction performance in the field for specific soils tested and/or specific soils previously tested available in a database. Again a response surface may be provided predicting performance both in degree of compaction produced as well as productivity rate with variation in field moisture content, depth of the soil lift (the amount of new soil added over previously compacted soil during the productivity cycle), and the number of repeated passes of the machine over the soil.

The algorithms may also predict the response of soil to compaction energy and predict the compaction machine capability 206 to produce compaction along with an anticipated rate of productivity. The predictive output is a "response surface" that shows both the maximum compaction and productivity along with reduced levels when soil conditions such a moisture content are less than at the optimal level. The present disclosure may be captured in analytical models combined with a soils database to provide a user tool for earthworks construction.

The present disclosure may provide forecasting of compaction machine performance and capabilities of machines to meet compaction requirements set by contracting authorities at the time of contract bids, and may also allow customers to ascertain optimal machine 206 selection and operation. Capabilities to meet compaction requirements are often a significant source of uncertainty for earthworks construction estimating. The present disclosure may reduce the degree of uncertainty for earth works construction estimating. The present disclosure may provide earlier compaction forecasting to meet contract bids, may also do so based upon machine 206 availability and selection parameters, as provided above.

Other aspects, objects, and advantages of the present invention can be obtained from a study of the drawings, the disclosure, and the claims.

I claim:

1. A system for forecasting soil compaction comprising:

an user interface configured to receive compaction data;

a database configured to provide compaction data;

a controller configured to determine a machine performance characteristic based on compaction data; and a communication device configured to communicate the compaction data between the database or between one or more machines; and wherein the compaction data includes a desired soil density input, a soil input, a machine characteristic, or a productivity parameter.

2. The system of claim 1, wherein the soil input does not include information specific to a soil compaction site.

3. The system of claim 1, wherein the communication device includes at least one of a wireless communication network and a landline.

4. The system of claim 1, wherein the database further includes data related to lift thickness.

5. The system of claim 1, wherein the soil characteristic includes a water content of the soil.

6. The system of claim 1, wherein the machine performance characteristic includes the number of passes for a specific machine to reach the desired soil density input.

7. The system of claim 1, wherein the machine performance characteristic includes the number of passes for multiple machines to reach the desired soil density input.

8. The system of claim 7, wherein the controller is configured to recommend a type of machine to be used for soil compaction based upon at least one of the desired soil density input, the soil input, the machine characteristics, the performance parameters, and the machine performance characteristic.

9. The system of claim 8, wherein the machine characteristics includes at least one of a yoke mass, a drum mass, a drum diameter, a drum width, a drum frequency, or a isomount stiffness.

10. The system of claim 6, wherein the controller is further configured to determine a travel route for a specific machine.

11. The system of claim 7, wherein the controller is further configured to determine a travel route for multiple machines.

12. The system of claim 1, wherein the controller is configured to update the machine performance characteristic based on dynamic measurements a soil characteristic during a compacting event.

13. A method for forecasting soil compaction including the steps of:

providing a desired soil density level;

providing at least one soil characteristic;

providing at least one machine characteristic;

calculating a machine performance characteristic from the desired soil compaction level, at least one soil characteristic, and at least one machine characteristic;

storing the machine performance characteristic in a database;

predicting a compaction level based on at least one soil characteristic, the machine characteristic; the machine performance characteristic, and the desired soil compaction level;

communicating the predicted compaction level to at least one machine; and compacting soil to the desired soil compaction level with the at least one machine in response to the predicted compaction level.

14. The method of claim 13, further including recommending one or more machines for soil compaction based on the predicted compaction level.

15. The method of claim 14, wherein recommending one or more machines includes factoring in machine operational costs.

16. The method of claim 13, wherein at least one soil characteristic is a water content value.

17. The method of claim 13, wherein at least one machine characteristic is a lift thickness value.

18. The method of claim 13, further including wirelessly communicating the predicted compaction level to the one or more machines.

19. The method of claim 13, wherein predicting the compaction level is based on performing dynamic measurements of the site specific soil characteristic during a compaction event.

20. A machine comprising:

an user interface configured to receive compaction data;

a controller configured to determine a machine performance characteristic based on compaction data;

a communication device configured to communicate the compaction data between a database or with a second machine;

wherein the compaction data includes a desired soil density input, a soil input, a machine characteristic, or a productivity parameter; and wherein the database is configured to provide compaction data.

* * * * *